US005497993A

United States Patent [19]

Shan

[11] Patent Number: 5,497,993

[45] Date of Patent: Mar. 12, 1996

[54] STRUCTURE OF GOLF CLUB HEAD

[76] Inventor: Shiau S. Shan, 5Fl., No. 412-12, 2 Sec., Chung Shan Rd., Tai Peiping, Taichung, Taiwan

[21] Appl. No.: 209,319

[22] Filed: Mar. 14, 1994

[51] Int. Cl.[6] ..... A63B 53/04

[52] U.S. Cl. ..... 273/167 H; 273/173; 273/167 J

[58] Field of Search ..... 273/167 R, 167 H, 273/167 J, 173, 175, 78, DIG. 23, 169, 167 F

[56] References Cited

U.S. PATENT DOCUMENTS

| | | | |
|---|---|---|---|
| 572,436 | 12/1896 | Mills | 273/173 |
| 1,678,637 | 7/1928 | Drevitson | 273/173 |
| 1,968,626 | 7/1934 | Young | 273/78 |
| 2,034,936 | 3/1936 | Barnhart | 273/173 |
| 3,695,618 | 10/1972 | Woolley | 273/173 |
| 3,847,399 | 11/1974 | Raymont | 273/78 |
| 4,511,145 | 4/1985 | Schmidt | 273/167 H |
| 4,664,383 | 5/1987 | Aizawa | 273/78 |
| 4,679,792 | 7/1987 | Straza | 273/173 |
| 4,681,322 | 7/1987 | Straza | 273/173 |
| 4,930,781 | 6/1990 | Allen | 273/78 |
| 5,000,454 | 3/1991 | Soda | 273/173 |
| 5,060,951 | 10/1991 | Allen | 273/167 H |
| 5,078,397 | 1/1992 | Aizawa | 273/173 |
| 5,301,941 | 4/1994 | Allen | 273/167 H |

*Primary Examiner*—Sebastiano Passaniti

*Attorney, Agent, or Firm*—Fay, Sharpe, Beall, Fagan, Minnich & McKee

[57] ABSTRACT

A golf club head having a neck at one end for connecting the shaft and a face panel at one side for hitting the ball, wherein the face panel consists of a meshed member made of a rigid metal and defining a plurality of open spaces, and a flexible blocking material blocking up the open spaces.

10 Claims, 2 Drawing Sheets

STRUCTURE OF GOLF CLUB HEAD

BACKGROUND OF THE INVENTION

The present invention relates to golf clubs, and more specifically relates to an improved structure of golf club head.

The golf is a game in which a small ball is hit successively into each of 9 or 18 holes arranged in a large open piece of land. As the ball for the game is small and of high hardness, it is not easy to hit the ball in the desired direction, and special techniques are needed in playing such a game. The head of a golf club may be made of any of a variety of materials. For example, there are cast head, forged head, carbon head, metal head, wooden head, etc. The face (striking surface) of the head of any of a variety of conventional golf clubs is commonly made solid and in integrity. When hitting, the contact between the face and the ball is a point of contact, and therefore it is very difficult to control the direction of the ball when a metal, cast, or forged head golf club is used. A wooden head golf club is less rigid and more easy to control the direction of the ball, however, it can not fit the ball to the satisfactory distance.

SUMMARY OF THE INVENTION

The present invention has been accomplished under the aforesaid circumstances. It is therefore an object of the present invention to provide a golf club head for a golf club which eliminates the aforesaid drawbacks. It is another object of the present invention to provide a golf club head for a golf club which greatly improves the striking power of the golf club. It is still another object of the present invention to provide a golf club head for a golf club which permits the user to control the direction of the ball easily.

To achieve these objects, there is provided a golf club head having a neck at one end for connecting the shaft and a face panel at one side for hitting the ball, wherein the face panel consists of a meshed member made of a rigid metal and defining a plurality of open spaces, and a flexible blocking material blocking up the open spaces.

DETAILED DESCRIPTION OF THE PREFERRED EMBODIMENT

Figure 1:
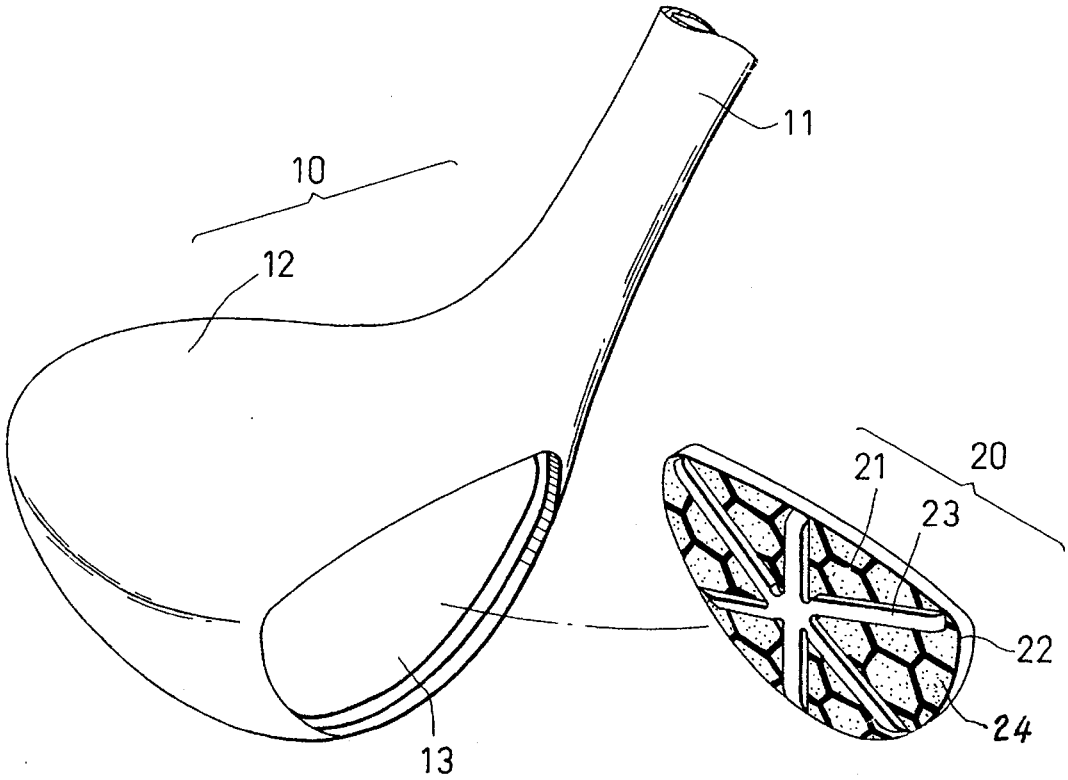
FIG. 1 is an exploded view of a golf club head according to the preferred embodiment of the present invention.
Figure 2:
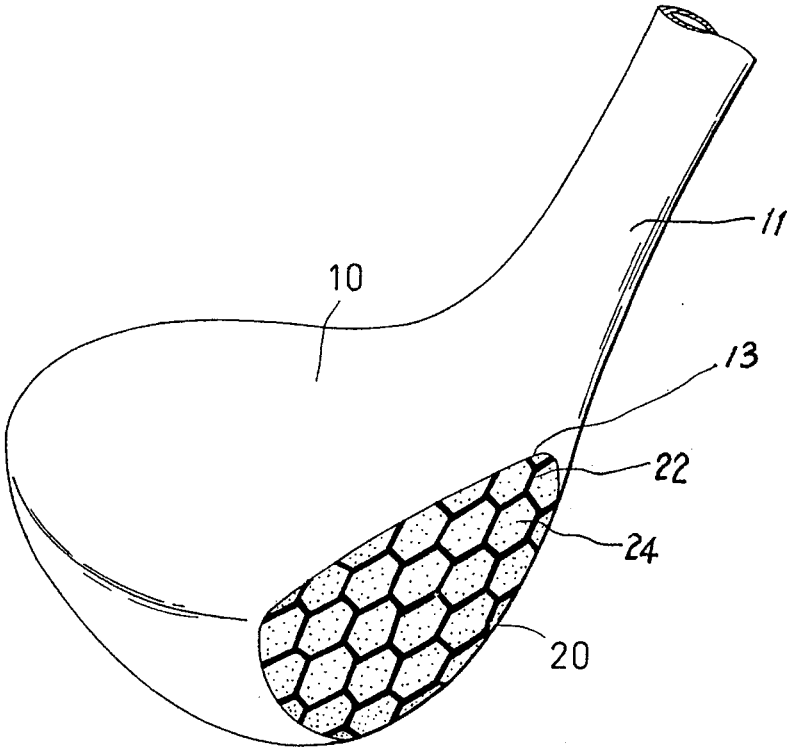
FIG. 2 is an elevational view of the golf club head shown in FIG. 1.

Referring to FIGS. 1 and 2, the club head 10, which can be of cast head, forged head, carbon head, metal head, is comprised of a body 12 having a neck 11 for connecting to the shaft, a arched crown 12,and a recessed striking area 13, and a face panel 20 fitted into the recessed striking area 13 on the body 12. The face panel 20 is comprised of a meshed member 22 made of stainless steel, aluminum, or any suitable rigid alloy, defining a plurality of open spaces 21 of circular, square, honeycomb (see FIG. 2) or any of a variety of shapes, a set of reinforcing ribs 23 intersected at the back side of the meshed member 22, and a flexible blocking material 24 blocking up the open spaces 21. The flexible blocking material 24 can be of carbon, ceramic, kevlar, ABS, borou, glass, PU, or rubber fibers.

Figure 3:
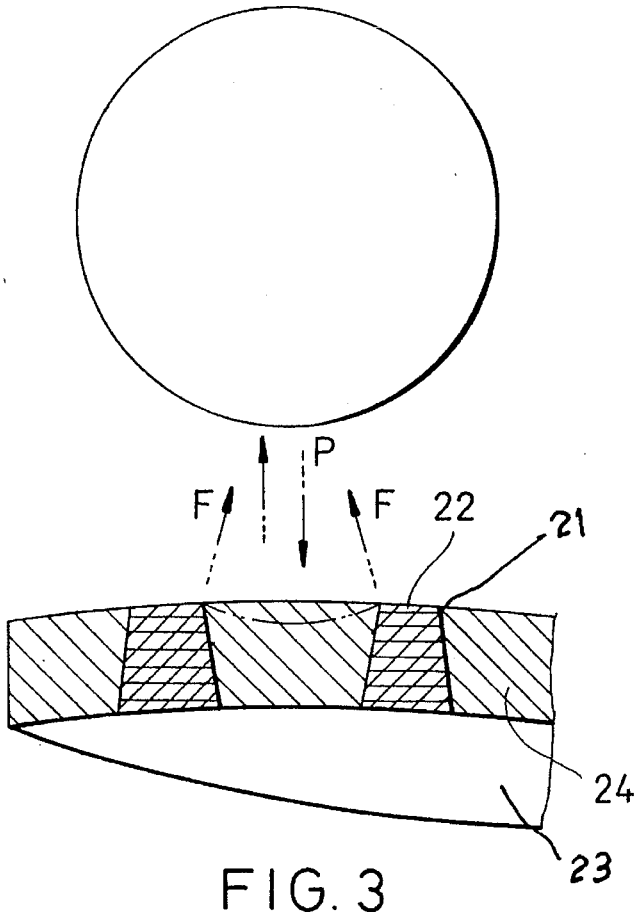
FIG. 3 shows the ball acted on the blocking material at either open space within the meshed member of the face panel.
Figure 4:
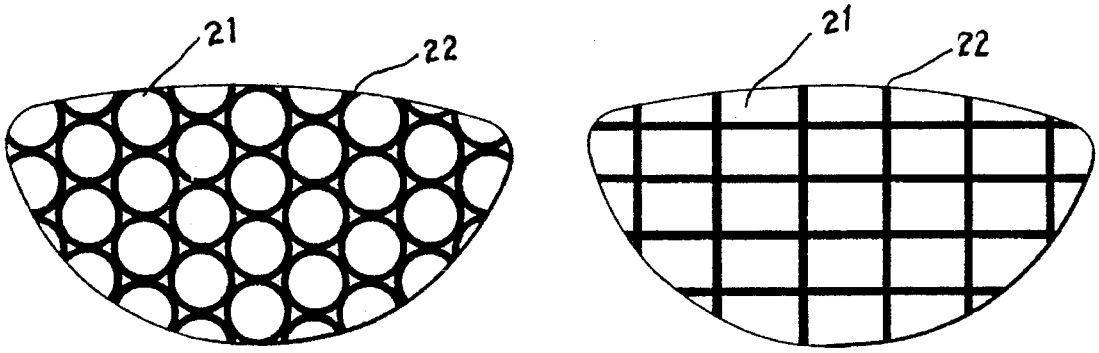
FIG. 4 shows alternate forms of the face panel.

Referring to FIG. 3 and FIG. 2 again, because the open spaces 21 on the meshed member 22 are blocked up by the flexible blocking material 24, the flexible blocking material 24 at the hitting point will be forced to deform and to produce a buffer action, permitting the ball to contact the meshed member 22. Therefore, the contact between the face panel 20 and the ball is a multiple point contact, and a reaction force F is produced at each point of contact. The reaction force at all points of contact is then gathered into a huge axial push force P to push the ball toward the desired direction.

What is claimed is:

1. A metal wood golf club head comprising a neck at one end for connecting a shaft and a face panel at one side for hitting a ball, wherein said face panel is comprised of a meshed member made of rigid metal bars defining a plurality of open spaces and a flexible blocking material filling said open spaces, at least a portion of said metal bars and said blocking material forming an exposed ball striking surface.

2. The golf club head of claim 1 wherein said meshed member includes a back side having a set of interconnected ribs.

3. The golf club head of claim 1 wherein said meshed member is a honeycomb structure.

4. A golf club, which is a composite high impact golf club head constructed of a metal, having a top wall, a bottom wall, a toe portion, a heel portion, a rear portion, and a front wall, said front wall including a recess accommodating an insert comprised of a plurality of bars forming an open ended cellular structure forming a plurality of cellular spaces and a flexible blocking material filling said cellular spaces, said insert forming the hitting surface of said club wherein a golf ball impacting said surface contacts an exposed portion of said open ended cellular structure and said flexible blocking material.

5. The club of claim 4 wherein said flexible blocking material is selected from the group consisting of carbon, ceramic, Kevlar, ABS, boron, glass, polyurethane, rubber fibers and mixtures thereof.

6. The club of claim 4 wherein said bars are comprised of stainless steel, aluminum, or a rigid alloy.

7. The club of claim 4 wherein said bars are interconnected.

8. The club of claim 4 wherein said bars comprise a honeycomb structure.

9. The club of claim 7 wherein said interconnected bars comprise a plurality of rectangular shaped cells.

10. The club of claim 4 wherein said bars have a back side including interconnected ribs.

* * * * *